US011344120B2

(12) United States Patent
Grabher

(10) Patent No.: US 11,344,120 B2
(45) Date of Patent: May 31, 2022

(54) POWER RAIL

(71) Applicant: Grass GmbH, Hoechst (AT)

(72) Inventor: Günter Grabher, Fussach (AT)

(73) Assignee: Grass GmbH, Hoechst (AT)

( * ) Notice: Subject to any disclaimer, the term of this patent is extended or adjusted under 35 U.S.C. 154(b) by 0 days.

(21) Appl. No.: 17/144,215

(22) Filed: Jan. 8, 2021

(65) Prior Publication Data

US 2021/0212464 A1 Jul. 15, 2021

(30) Foreign Application Priority Data

Jan. 9, 2020 (DE) ..... 20 2020 100 078.0

(51) Int. Cl.
*A47B 88/919* (2017.01)
*A47B 97/00* (2006.01)

(52) U.S. Cl.
CPC ..... *A47B 88/919* (2017.01); *A47B 97/00* (2013.01); *A47B 2220/0077* (2013.01); *A47B 2220/0091* (2013.01)

(58) Field of Classification Search
CPC ..... A47B 88/919; A47B 97/00; A47B 2220/0077; A47B 2220/0091
See application file for complete search history.

(56) References Cited

U.S. PATENT DOCUMENTS

2002/0171335 A1 11/2002 Held
2014/0227893 A1* 8/2014 Howard ..... A47B 97/00 439/121
2020/0040576 A1* 2/2020 Broekhuis ..... E04C 2/521
2020/0077796 A1* 3/2020 Miles ..... B66F 9/12
2020/0408399 A1* 12/2020 Doerflinger ..... F21V 33/0084
(Continued)

FOREIGN PATENT DOCUMENTS

AT 413 185 B 12/2005
DE 29 11 442 A1 9/1980
DE 33 03 727 A1 8/1984
(Continued)

OTHER PUBLICATIONS

English translation of the International Preliminary Report on Patentability (Chapter I) (Application No. PCT/EP2019/074951) dated Apr. 1, 2021.

(Continued)

*Primary Examiner* — Daniel J Rohrhoff
(74) *Attorney, Agent, or Firm* — Burr & Brown, PLLC

(57) ABSTRACT

A power rail for arrangement on a pull-out guide for a movable furniture part, wherein the pull-out guide has a body rail and a drawer rail, which are supported such that they are movable relative to each other, wherein the power rail is designed such that it can be arranged on the body rail or on the drawer rail, wherein the power rail is designed, when arranged on the pull-out guide, to extend along the length of the body rail and/or along the length of the drawer rail in a direction of movement of the pull-out guide, wherein the power rail has two contact elements insulated electrically from each other, wherein the contact elements are designed to be electrically conductive, so that a current collector of a power supply unit can come into contact with one of the contact elements in order to produce an electrically conductive connection.

14 Claims, 5 Drawing Sheets

(56) References Cited

U.S. PATENT DOCUMENTS

| | | | | |
|---|---|---|---|---|
| 2021/0267372 | A1* | 9/2021 | Garcia | F21V 23/06 |
| 2021/0293401 | A1* | 9/2021 | Volkov | F21V 23/04 |

FOREIGN PATENT DOCUMENTS

| | | | |
|---|---|---|---|
| DE | 20 2008 000 195 | | 4/2008 |
| DE | 20 2011 005 006 | U1 | 7/2014 |
| DE | 10 2018 115 585 | A1 | 1/2020 |
| GB | 2 049 404 | A | 12/1980 |
| IT | VI20 100 098 | A1 | 10/2011 |

OTHER PUBLICATIONS

Extended European Search Report (Application No. 20215071.0) dated Jun. 7, 2021.
German Search Report (Application No. 20 2020 100 078.0) dated Sep. 3, 2020.

* cited by examiner

POWER RAIL

This application claims the benefit under 35 USC § 119(a)-(d) of German Application No. 20 2020 100 078.0 filed Jan. 9, 2020, the entirety of which is incorporated herein by reference.

BACKGROUND OF THE INVENTION

Items of furniture comprising a furniture body and a furniture part that can be moved relative to the furniture body, such as a flap or a drawer, are known. Likewise known is a power supply to the movable furniture part in order to supply the movable furniture part with electrical energy and, therefore, for example, to implement the illumination of the movable furniture part, in particular, when opened relative to the furniture body. For example, a drawer interior can be illuminated in this way.

In known furniture, the movable furniture part is provided with an energy store, for example, a battery or a rechargeable battery. It is also known to supply such an energy store with energy, for example, to charge the same, when the movable furniture part is closed relative to the furniture body, wherein, when opened, an electrically conductive contact between the energy store and power supply is interrupted. The disadvantage with the known solutions is that the movable furniture part, in particular, when opened relative to the furniture body, can be supplied only with a limited quantity of energy or a limited amount of power, for example, the capacity or power of the battery. In this way, the functional flexibility of the movable furniture part is limited.

SUMMARY OF THE INVENTION

The present invention is based on the object of providing a device by means of which an energy supply of a movable furniture part, for example, an energy supply of a drawer, is improved. In particular to provide a device by means of which a transfer of energy to the movable furniture part is improved.

The present invention is based on a power rail for arrangement on a pull-out guide, wherein the pull-out guide is designed for the movable support of a movable furniture part, wherein the pull-out guide has a body rail and a drawer rail, which are movably supported relative to each other.

It is also conceivable that the power rail is designed to be arranged on a furniture body, for example, on a side wall of the furniture body. Advantageously, the movable furniture part is movably supported on the furniture body. For example, the movable furniture part is designed as a drawer. For example, the movable furniture part can be moved from a closed state relative to the furniture body into an opened state relative to the furniture body. It can also be imagined that the power rail is designed to be arranged on the movable furniture part, in particular, the drawer, for example, on a bottom of the drawer. Advantageously, the power rail is designed to be arranged on the pull-out guide, on the furniture body and/or on the movable furniture part.

The power rail is, for example, a furniture power rail. In particular, the power rail is a pull-out guide power rail, for example, a furniture pull-out guide power rail.

An advantageous embodiment of the present invention is to be seen in that the power rail is designed such that it can be arranged on the body rail and/or on the drawer rail, wherein the power rail is designed, when arranged on the pull-out guide, to extend along the length of the body rail and/or along the length of the drawer rail in a direction of movement of the pull-out guide, wherein the power rail has two contact elements electrically insulated from each other, wherein the contact elements are designed to be electrically conductive, so that a current collector of a power supply unit can come into contact with one of the contact elements in order to produce an electrically conductive connection. In this way, a solution which is comparatively simple and/or can be retrofitted on the furniture part is provided in order to supply the movable furniture part with energy. In particular, a comparatively reliable solution to the power supply of the movable furniture part is provided in this way.

Preferably, the power rail is designed, when arranged on the pull-out guide, to extend with a length of the power rail along the length of the body rail and/or along the length of the drawer rail in a direction of movement of the pull-out guide.

Advantageously, the power rail extends in the length, in a width and in a height. It is also conceivable that, in the case in which the power rail is arranged on the movable furniture part, the power rail extends with its length along a direction of movement of the movable furniture part. For example, when arranged on the drawer, the power rail extends with its length between a drawer rear wall and a drawer front of the drawer. For example, when arranged on the furniture side wall, the power rail extends with its length between a furniture rear wall of the furniture and a furniture front of the furniture.

Preferably, when arranged on the pull-out guide, the power rail extends with its length over more than half the length of the body rail and/or more than half the length of the drawer rail in a direction of movement of the pull-out guide. For example, when arranged on the pull-out guide, the power rail extends with its length over more than 20%, over more than 30%, over more than 40%, over more than 50%, over more than 60%, over more than 70%, over more than 80%, over more than 90%, over more than 100%, over more than 110% or over more than 120% of the length of the body rail and/or the length of the drawer rail. Advantageously, the power rail is designed to be longer than a rail of the pull-out guide, for example, longer than the body rail and/or longer than the drawer rail.

Advantageously, the power rail is 150 mm to 800 mm long. For example, the power rail is 200 mm to 750 mm, 400 mm to 650 mm or 450 mm to 500 mm long. It can also be imagined that the length of the power rail is more than 150 mm, more than 200 mm, more than 300 mm, more than 400 mm or more than 450 mm. Preferably, a contact element of the power rail is 150 mm to 800 mm long. For example, the contact element of the power rail is 200 mm to 750 mm, 400 mm to 650 mm or 450 mm to 500 mm long. It can be imagined that the length of the contact element of the power rail is more than 150 mm, more than 200 mm, more than 300 mm, more than 400 mm or more than 450 mm.

Advantageously, the contact of the current collector with the contact element is an electrically conductive contact. For example, both the current collector and the contact element each comprise an electrically conductive member, wherein the electrically conductive members in the contact with the current collector have an electrically conductive contact with the contact element.

It is also proposed that the power rail is designed such that it can be detachably arranged on the body rail and/or that the power rail is designed such that it can be detachably arranged on the drawer rail. It is also conceivable that the power rail is designed such that it can be detachably arranged on the drawer and/or on the drawer side wall. In this way, the power rail can be used comparatively flexibly on the furniture. In particular, mounting the power rail is made comparatively simpler in this way.

It is further proposed that each contact element of the power rail is designed as a wiping contact. In this way, making contact between the power rail and the current collector is advantageously comparatively simply ensured in different positions of the current collector relative to the power rail, for example, during a movement of the current collector relative to the power rail.

For example, the contact elements are designed as linear wiping contacts. Advantageously, the contact element is a track element. For example, the contact element is designed as a conductor track element. For example, the contact element is a metal strip or a sheet metal strip. For example, the contact element is designed as a copper strip.

In an advantageous refinement of the present invention, the contact elements of the power rail are spring mounted when arranged. For example, when arranged on the body rail and/or when arranged on the drawer rail, the contact elements of the power rail are spring-mounted. In this way, the power rail is designed to be comparatively destruction-free, in particular long-lasting.

Advantageously, the contact elements of the power rail are springy wiping contacts. For example, the power rail comprises a spring element, for example, a spring, by means of which a contact element is spring-mounted on the power rail. For example, a contact element comprises the spring element. For example, the contact element is designed as a spring element. It can be imagined that the contact element is spring-mounted on the remaining power rail, in particular, is connected to the latter, by means of a springy or resilient spring element, for example, a rubber strip. It is also conceivable that when arranged on the pull-out guide, on the body side wall and/or on the drawer bottom, the power rail is spring-mounted via a spring element, for example, via a resilient metal tongue. For example, by means of a springy mounting of the power rail, the contact element of the power rail is also spring-mounted.

It likewise proves to be advantageous if the contact elements are a current-conducting coating on the power rail. In this way, the power rail can be produced comparatively economically.

Advantageously, the power rail comprises a base which is formed from an electrically insulating, in particular non-conducting, material. Advantageously, the contact elements are attached to the base, for example, applied and/or embedded. It is conceivable that a contact element is formed as a metal strip and embedded in the base. The base having the contact elements is, for example, formed as a printed circuit board (PCB). It is additionally conceivable that the base is arranged, for example, adhesively bonded, on a carrier rail. The carrier rail is, for example, formed from metal, for example, from a sheet metal or aluminum.

It is also advantageous if the power rail has a base on which the contact elements are present, wherein the power rail comprises a mounting element in order to arrange the power rail on the body rail and/or on the drawer rail, wherein the power rail is clamped onto the mounting element. In this way, mounting of the power rail on the pull-out guide is simplified.

Advantageously, the power rail can be screwed, clipped and/or clamped to the body rail and/or to the drawer rail. Preferably, the mounting element can be designed to be screwed, clipped and/or clamped onto the body rail and/or onto the drawer rail. For example, the mounting element comprises a quick-release fastener and/or snap fastener. In this way, the mounting element is designed so as to be able to be arranged comparatively easily on the pull-out guide. For example, the mounting element is designed, when arranged on the pull-out guide, to be clipped and/or clamped onto the pull-out guide.

It is also conceivable that the power rail is mounted such that it can be guided displaceably in a guide of the mounting element. Advantageously, mounting of the power rail on the pull-out guide is simplified thereby.

For example, the power rail and the mounting element are bonded to each other. The mounting element is, for example, formed of metal, for example, of sheet metal or aluminum.

For example, the power rail comprises two mounting elements, wherein a first mounting element is present in a fixed position with the base of the power rail, for example, adhesively bonded, wherein a second mounting element is present such that it can be displaced relative to the base along a longitudinal extent of the base. For example, the second mounting element is movable relative to the first mounting element. Advantageously, the power rail is supported in a manner resting on a mounting element. It is also conceivable that a mounting element is designed such that it can be clamped and/or screwed onto the power rail.

An advantageous modification of the present invention is a power supply unit having a power rail according to one of the preceding variants, wherein the power supply unit comprises a contact-making unit in order to apply an electrical voltage to the contact elements of the power rail when arranged on the furniture. Advantageously, when arranged on the furniture, the contact-making element is clamped and/or screwed to the power rail, in particular, to the mounting element. When mounted on the furniture, the contact-making unit is advantageously electrically conductively connected to a power supply system, for example, a low voltage supply system. The power supply unit is, for example, designed as a furniture power supply unit. It can be imagined that the power rail is designed to have a DC voltage and/or an AC voltage applied. For example, the DC voltage is 12 V DC, 24 V DC and/or 48 V DC.

In addition, it is advantageous if the power supply unit has a current collector, wherein the current collector has at least two current-collecting elements, wherein, when arranged on the furniture, in each case a power collector element and a contact element are in electrically conductive contact in at least one position, wherein the current collector is designed such that it can be arranged on the power rail, on the body rail, on the drawer rail, on the movable furniture part and/or on a furniture body. In this way, a power supply to the movable furniture part can be implemented comparatively simply and reliably. For example, the current collector is designed such that it can be mounted on a corner post of the drawer or a frame of the drawer. Advantageously, when the power supply unit is arranged, a current-collecting element and a contact element have an electrically conductive contact when the movable furniture part is closed relative to the furniture body and therefore when the pull-out guide is closed.

For example, the power supply unit is formed in such a way that, when arranged on the furniture, the current collector is in electrically conductive contact with the power rail, in particular in electrically conductive contact with a contact element of the power rail, both when the movable furniture part is open relative to the furniture body and when the movable furniture part is closed relative to the furniture body. Advantageously, when arranged on the furniture, a current-collecting element of the current collector and a contact element are in electrically conductive contact with each other at all times and/or in every relative position. For example, the power supply unit is formed in such a way that, when arranged on the furniture, the current collector is in electrically conductive contact with a contact element of the power rail in every opened state of the movable furniture part relative to the furniture body.

It is also proposed that the current collector comprises a transmitting element, by means of which energy can be transmitted without contact to a current receiving element. Advantageously, the transmitting element comprises a coil. For example, the transmitting element is a coil. It is also conceivable that the current collector has a control module in order to control the transfer of energy. Preferably, the current receiving element is designed to be arranged on a rear side of a drawer rear wall. For example, the current receiving element comprises a coil. Advantageously, the current receiving element comprises an energy store. In this way, an electrical unit of the drawer, such as an illumination system, can also be supplied with electrical energy in an opened state.

Likewise, it is advantageous if a current-collecting element has a contact-making member to which a spring force is applied for making electrically conductive contact with a contact element. In this way, an in particular continuous sliding and/or wiping contact between contact-making member and contact element can be implemented. For example, the current-collecting element comprises a spring member, for example, in the form of a spring. It is conceivable that the spring is designed as a helical spring. For example, when arranged between a current-collecting element and a contact element, there is a wiping contact and/or a sliding contact.

It is moreover proposed that the current collector can be detachably connected to the power rail. For example, the current collector can be detachably connected to the base of the power rail. In this way, mounting of the current collector on the power rail or disassembly can be implemented comparatively simply.

It is possible to imagine that the current collector has a fixing element, by means of which the current collector can be clamped or screwed onto the power rail. For example, the current collector and the power rail are designed such that the current collector can be mounted movably on the power rail. For example, the current collector can be mounted on the power rail such that it can be displaced, for example, in a sliding manner. It is also possible to imagine that the current collector is movably guided on the power rail. For example, the power rail comprises a guide element, for example, a guide, in order to guide the current collector displaceably. Advantageously, the guide element is designed such that the current collector is displaceably guided along the length of the power rail.

A further advantageous modification of the present invention is a pull-out guide, wherein the pull-out guide has the body rail and the drawer rail, and wherein the pull-out guide comprises the power rail according to one of the aforementioned embodiments or the power supply unit according to one of the aforementioned embodiments.

One advantageous embodiment of the present invention is an item of furniture having a pull-out guide according to one of the aforementioned variants or an item of furniture having a power rail according to one of the aforementioned embodiments or an item of furniture having a power supply unit according to one of the aforementioned embodiments.

BRIEF DESCRIPTION OF THE DRAWINGS

Several exemplary embodiments will be explained in more detail by using the following schematic drawings with the indication of further details and advantages.

DETAILED DESCRIPTION OF THE DRAWINGS

Figure 1:
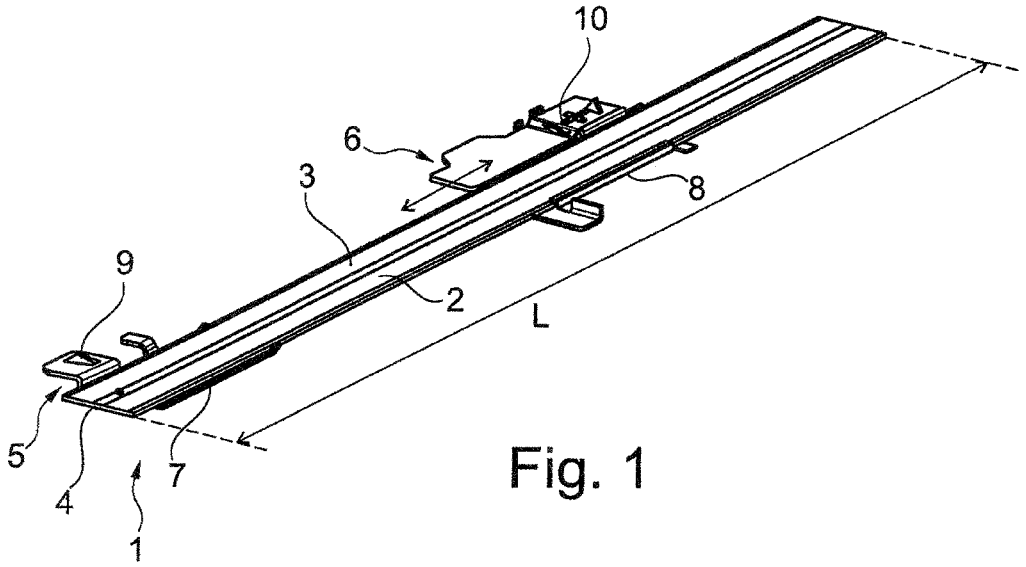
FIG. 1 shows a power rail according to the present invention in a perspective front side view from above.

FIG. 1 shows a power rail 1 having two contact elements 2, 3, which are arranged on a base 4 of the power rail 1. FIG. 1 additionally shows that the power rail 1 is arranged to rest on mounting elements 5, 6.

Advantageously, the base 4 is formed as a circuit board or as a printed circuit board. The contact elements 2, 3 are, for example, in particular, flat conductor tracks. For example, the contact elements 2, 3 are formed as metal strips and are attached to the base 4 and/or embedded in the latter. It is also conceivable that the contact elements 2, 3 are formed as an in particular surface coating on the base 4. Advantageously, the contact elements 2, 3 are arranged on the base 4 so as to be electrically insulated from each other. It is additionally conceivable that the contact elements 2, 3 are formed as wiping contacts. The power rail 1 is, for example, present in the form of meterware. In this way, the power rail 1 can be matched comparatively flexibly to different dimensions of a pull-out guide or an item of furniture, in particular, such that it can be cut to length. Advantageously, the power rail 1 can be cut to an in particular defined length L. For example, the power rail 1 has, in addition to the length L, a height H and a width B.

The power rail 1 is arranged with the base 4 advantageously resting on the mounting elements 5, 6. For example, the power rail 1 is clamped to the mounting elements 5, 6. Advantageously, the mounting elements 5, 6 comprise guide rails 7, 8, on which the power rail 1 can, in particular, be displaceably mounted and/or displaceably guided.

It is also possible to imagine, for example, that the power rail 1 is immovably arranged on a first mounting element 5 of the mounting elements 5, 6. Advantageously, when arranged, the mounting element 5 is immovable relative to the power rail 1. Preferably, in the arranged state, the second mounting element 6 of the mounting elements 5, 6 is designed to be displaceable relative to the power rail 1, in particular, along a longitudinal extent of the power rail 1.

For example, mounting members 9, 10 are formed on the mounting elements 5, 6, in order to fix, for example, to clamp (see FIG. 2) the power rail 1 without tools to a pull-out guide 11. The pull-out guide 11 comprises, for example, a body rail 14, a central rail 15 and a drawer rail 16. The pull-out guide 11 is, for example, designed as a full-extension unit. Advantageously, an attachment element 17 for attaching a drawer front (not shown) is present on the drawer rail 16.

It can be imagined that the guide rails 7, 8 are resiliently connected to the mounting members 9, 10. In this way, springing of the power rail 1 in a direction transverse to the longitudinal extent of the power rail 1 can be implemented. It is also conceivable that the base 4 of the power rail 1 is designed to be elastic. In this way, the contact elements 2, 3 are arranged in an elastic and/or sprung manner on the power rail 1.

Figure 2:
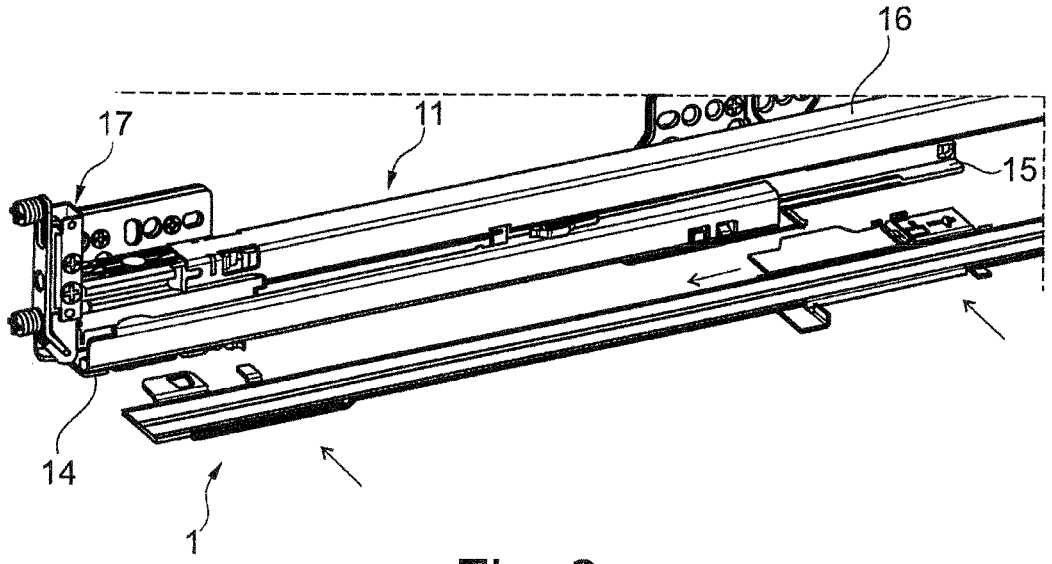
FIG. 2 shows the power rail according to FIG. 1 in a first mounting position relative to a pull-out guide in a further perspective partial front side view from above.

A mounting operation can be configured, for example, in such a way that, starting from a first mounting position, in which the power rail 1 is, for example, aligned parallel to the pull-out guide 11, the power rail 1 having the mounting elements 5, 6 is plugged on to the pull-out guide 11 in a direction transverse to the longitudinal extent of the power rail 1 and transverse to a longitudinal extent of the pull-out guide 11 (see FIG. 2). Advantageously, during this first mounting operation, the first mounting element 5 is clamped to the pull-out guide 11, so that the first mounting element 5 is immovably connected to the pull-out guide 11. For example, in a subsequent mounting operation, the second mounting element 6 is moved relative to the power rail 1 in a direction along the longitudinal extent of the power rail 1 and/or the pull-out guide 11 and clamped and/or clipped (not shown) to the pull-out guide 11.

Figure 3:
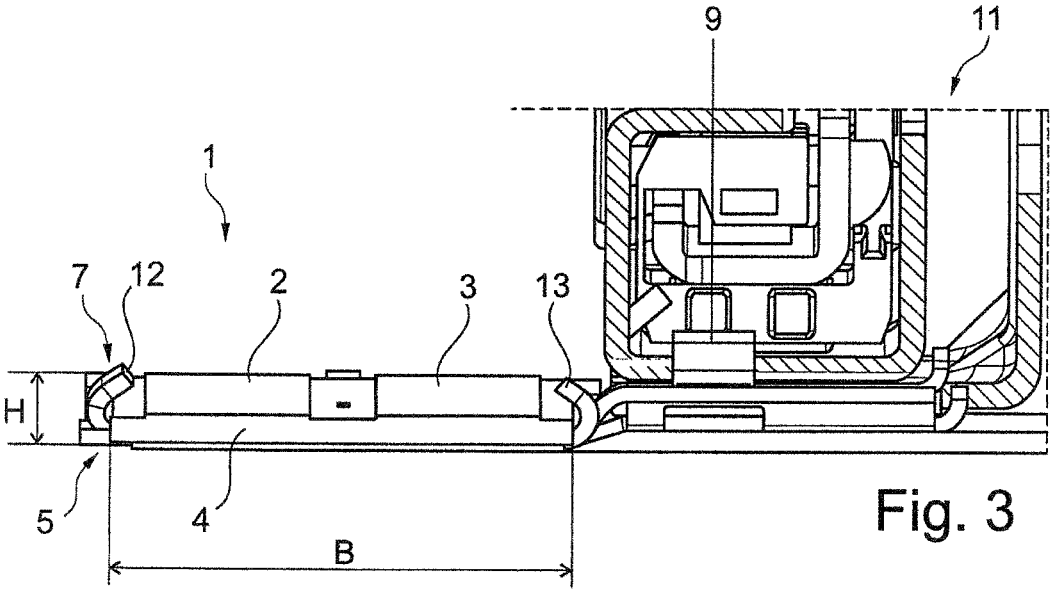
FIG. 3 shows a sectional view through the power rail and the pull-out guide according to FIG. 2 transversely relative to the longitudinal extent of the power rail, wherein the power rail is arranged in a final mounting position on the pull-out guide.

A sectional view from a direction from behind through the power rail 1 when arranged on the pull-out guide 11 is shown in FIG. 3. In FIG. 3, the guide rail 7 is shown. For example, the power rail 1 is guided firstly on the first mounting element 5 by means of the guide rail 7 and secondly because of the bent-over metal tabs 12, 13 of the guide rail 7.

Figure 4:
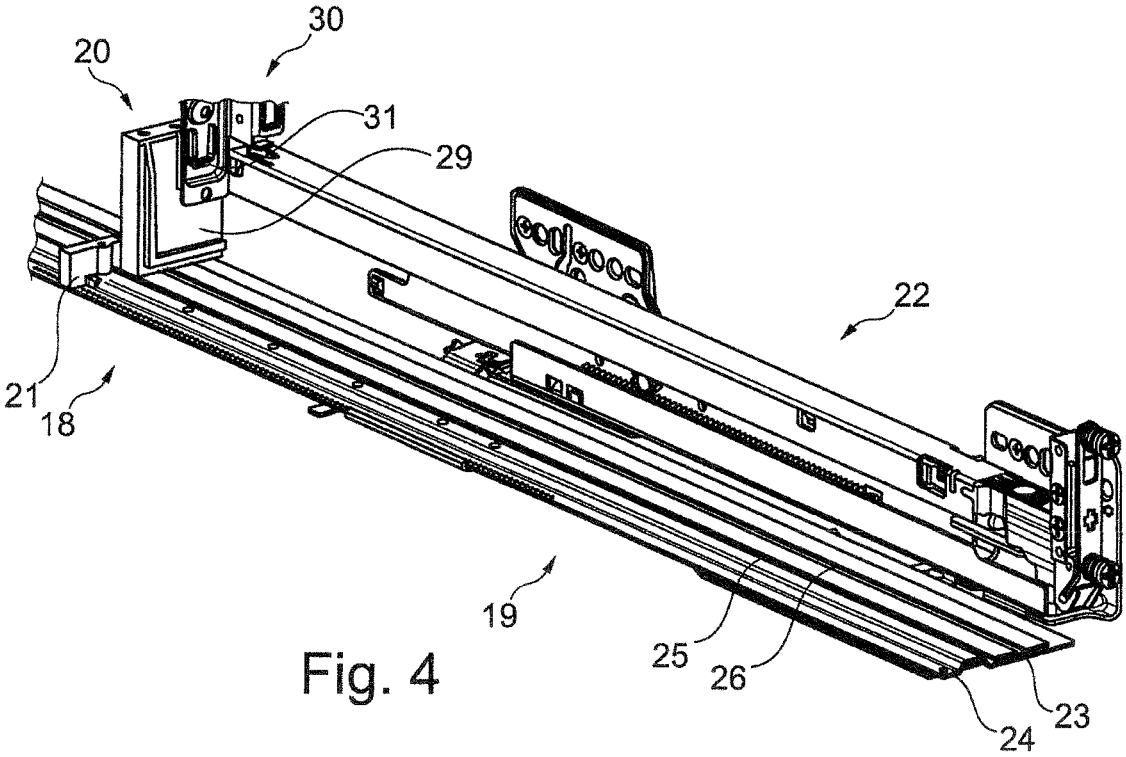
FIG. 4 shows a further variant of a power supply unit when arranged on a pull-out guide in a partial front side view from above.

In FIG. 4, a power supply unit 18 is illustrated, which comprises a further variant of a power rail 19, a current collector 20 and a contact-making unit 21. The power supply unit 18 in FIG. 4 is arranged on a further pull-out guide 22.

The power rail 19 according to FIG. 4 comprises a base 23, which is arranged on a rail 24. On the base 23 there are contact elements 25, 26. Advantageously, the rail 24 is formed as a bent sheet metal part or as an extruded profile.

For example, the current collector 20 is fixed to an attachment element 30 for attachment of a drawer rear wall (not shown). By means of the contact-making unit 21, a voltage, for example, energy, can advantageously be applied to the power rail 19. For example, the contact-making unit 21 can be connected to an external power supply system by means of cables 32 (see FIGS. 7 to 9).

The current collector 20 comprises two current-collecting elements 27, 28, which are each in electrically conductive contact with a respective contact element 25, 26 when arranged in at least one relative position of the current collector 20 relative to the power rail 19. Advantageously, the current collector 20 comprises a housing 29. For example, the housing 29 has a fixing member 31, by means of which the housing 29 can be attached, in particular clamped, to the attachment element 30. The fixing member 31 is formed, for example, as a springy lug.

Figure 6:
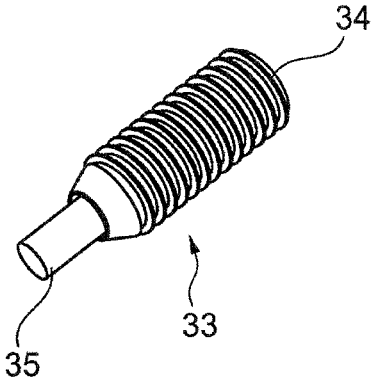
FIG. 6 shows a perspective view of a contact-making member of a power supply unit.

A variant of a current-collecting element 33 is shown in FIG. 6. For example, the current-collecting elements 27, 28 correspond to the current-collecting element 33. The current-collecting element 33 comprises a mounting sleeve 34, by means of which the current-collecting element 33 can be fixed to a housing of a current collector. A contact-making member 35 is supported, advantageously movably supported, in the mounting sleeve 34. For example, the contact-making member 35 is present on the mounting sleeve 34 so as to have a force applied by means of a spring element (not shown). In this way, when there is a pressure in the direction of the mounting sleeve 34, the spring element can give way in the direction of the mounting sleeve 34, for example, into an interior of the mounting sleeve 34, advantageously counter to the force of the spring element. When arranged on the power rail, the contact-making member 35 is, for example, designed to touch a contact element of the power rail and, during a movement of the contact-making member relative to the power rail, to slide and/or to wipe along the contact element in a contacting manner.

Figure 7:
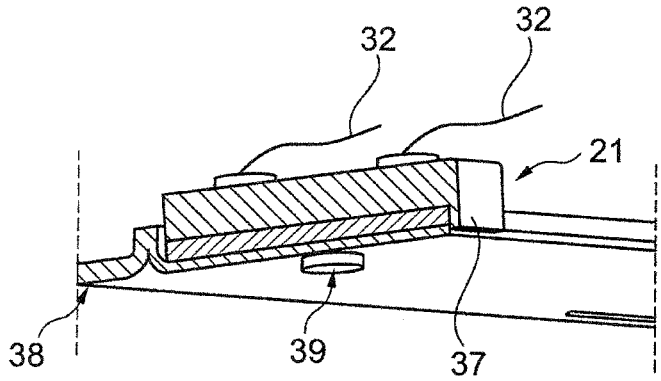
FIGS. 7 to 9 each show a perspective partial rear side view of a power rail, wherein a contact-making unit is arranged on the power rail.
Figure 8:
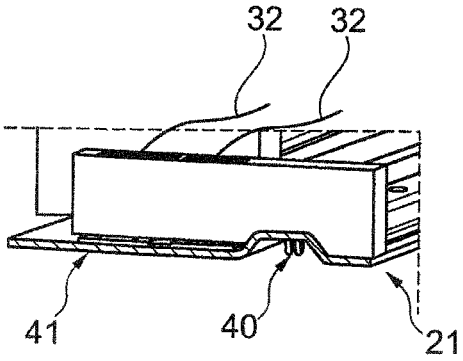
Figure 9:
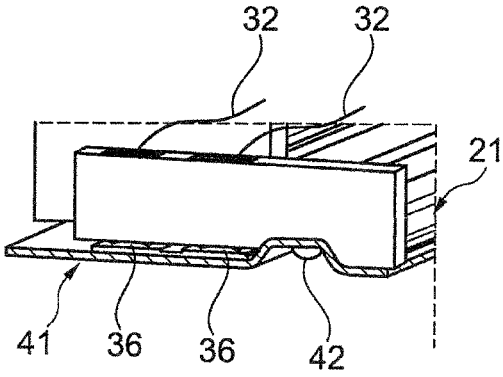
Figure 5:
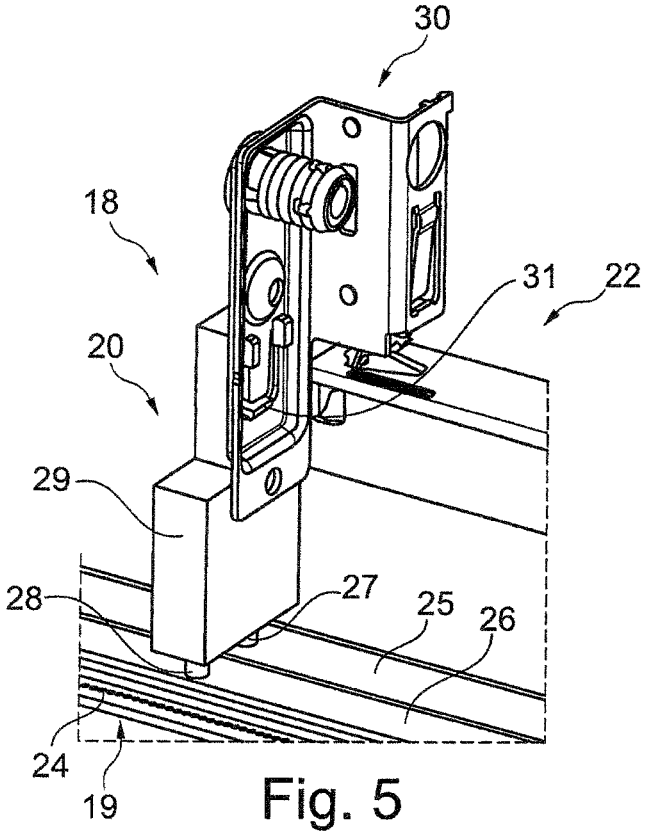
FIG. 5 shows a perspective partial front side view from above of the current collector of the power supply unit according to FIG. 4.

Variants of the contact-making unit 21 are illustrated in FIGS. 7, 8 and 9. For easier understanding, all the variants of the contact-making units are provided with the same designation 21. The fact that the contact-making units 21 can be connected to an external power supply system by means of cables 32 is common to all variants. Likewise common to all variants is the fact that the contact-making units 21 have connecting elements 36 in order to connect the cable 32 electrically conductively to the contact elements of the power rail.

A first variant of the contact-making unit 21 according to FIG. 7 is formed as a strip and comprises a stop element 37 in order to arrange the contact-making unit 21 comparatively simply, reliably and/or repeatably reliably on a power rail 38. The variant of the contact-making unit 21 according to FIG. 7 can be connected to the power rail 38 via a screw 39, for example.

The variant of the contact-making unit 21 according to FIG. 8 comprises a fixing element 40, by means of which the contact-making unit 21 can be clamped to the power rail 41. For example, the fixing element 40 is formed as a stopper which has springy tabs which, in the arranged state, engage behind or snap behind the power rail 41.

The variant of the contact-making unit 21 according to FIG. 9 is constructed similarly to the variant of the contact-making unit 21 according to FIG. 8, wherein, instead of the fixing element 40, the contact-making unit 21 is fixed to the power rail 41 by means of a screw connection 42.

Figure 10:
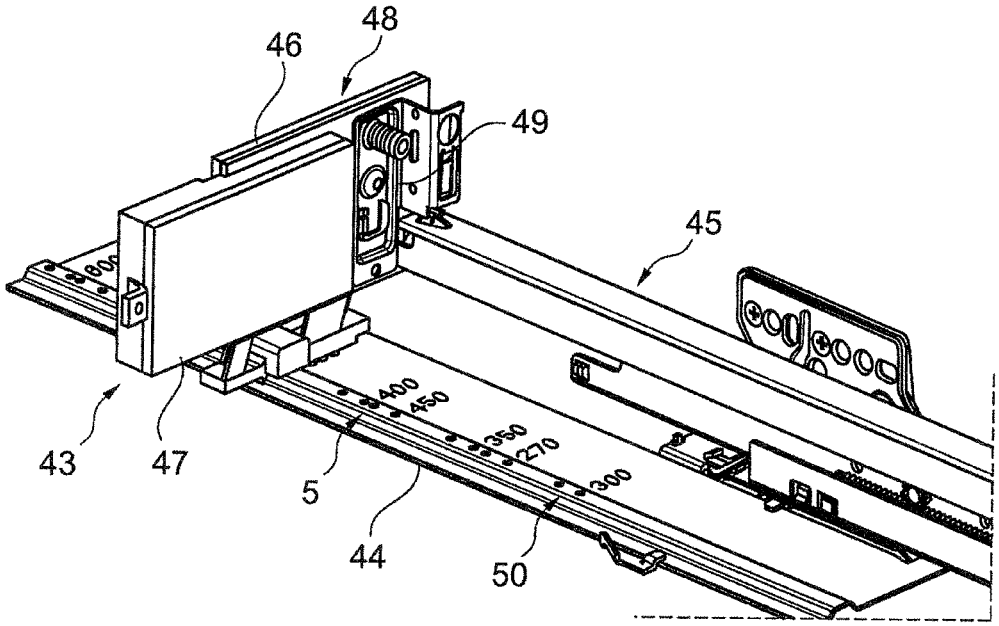
FIG. 10 shows a perspective partial front side view from above of a power supply unit without power rail when arranged on the pull-out guide and on a corner post of a drawer.

A further variant of a power supply unit 43 when arranged on a rail 44, and a pull-out guide 45 is shown in FIG. 10. For example, a power rail (not shown) can be arranged on the rail 44. The power supply unit 43 advantageously comprises a transmitting element 46, by means of which energy can be transmitted in a wire-free manner to a current receiving element 47. The transmitting element 46 comprises, for example, a coil (not shown) for this purpose, which means that energy can be transferred inductively. The transmitting element 46 is advantageously formed in the housing 48 of the power supply unit 43. The power supply unit 43 can, for example, be fixed to the rail 44 in a fixed position. The current receiving element 47 can be, for example, analogously to the power supply unit 18, arranged on an attachment element 49 for the arrangement of a drawer rear wall.

In this way, the current receiving element 47 is movable relative to the transmitting element 46 along a direction of movement of the pull-out guide 45.

The rail 44 is, for example, present in a defined length and, in this variant, forms an unmodified, in particular standardized, contact-making possibility for the power supply unit 43. Advantageously, the rail 44 has predefined mounting points 50 for this purpose, which are matched to a pull-out length of the pull-out guides 45. Advantageously, the transmitting element 45 can be arranged in a fixed position at the mounting points 50.

Figure 11:
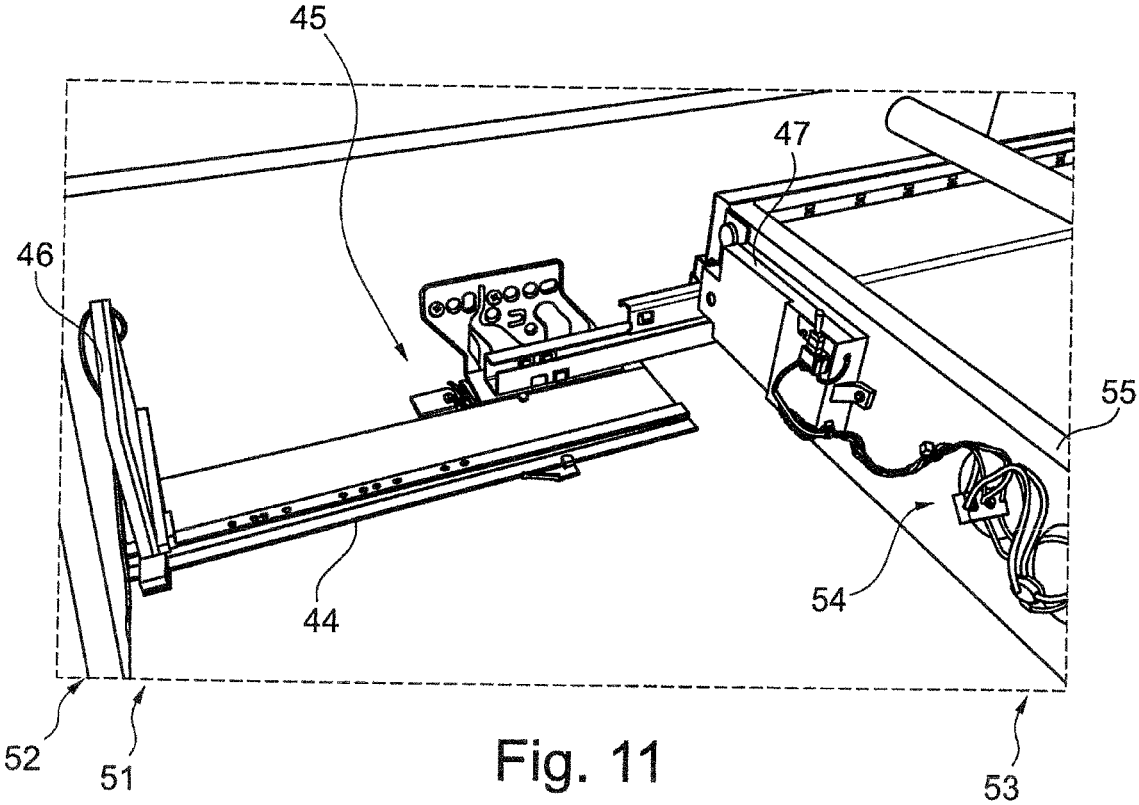
FIG. 11 shows a perspective partial rear side view from above of an item of furniture with an arranged power supply unit.

In FIG. 11, the pull-out guide 45 having the rail 44 and the power supply unit 43 is shown when arranged on an item of furniture 51. The item of furniture 51 comprises a body 52, on which a drawer 53 is movably arranged via the pull-out guide 45. It is shown that the housing 48 of the power supply unit 43 is arranged in a rear region of the body 52. Advantageously, the current receiving element 47 is fixed to a rear side 54 of a rear wall 55 of the drawer 53. In this way, when the drawer 53 on the body 52 is closed, a transmission of energy from the transmitting element 46 to the current receiving element 47 can be implemented.

Figure 13:
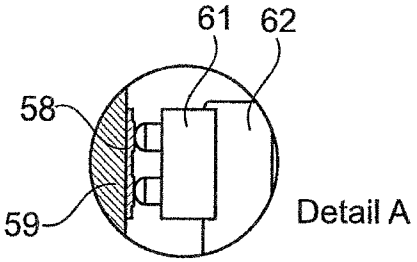
FIGS. 13 to 15 show detailed views of the power supply units according to FIG. 12.
Figure 12:
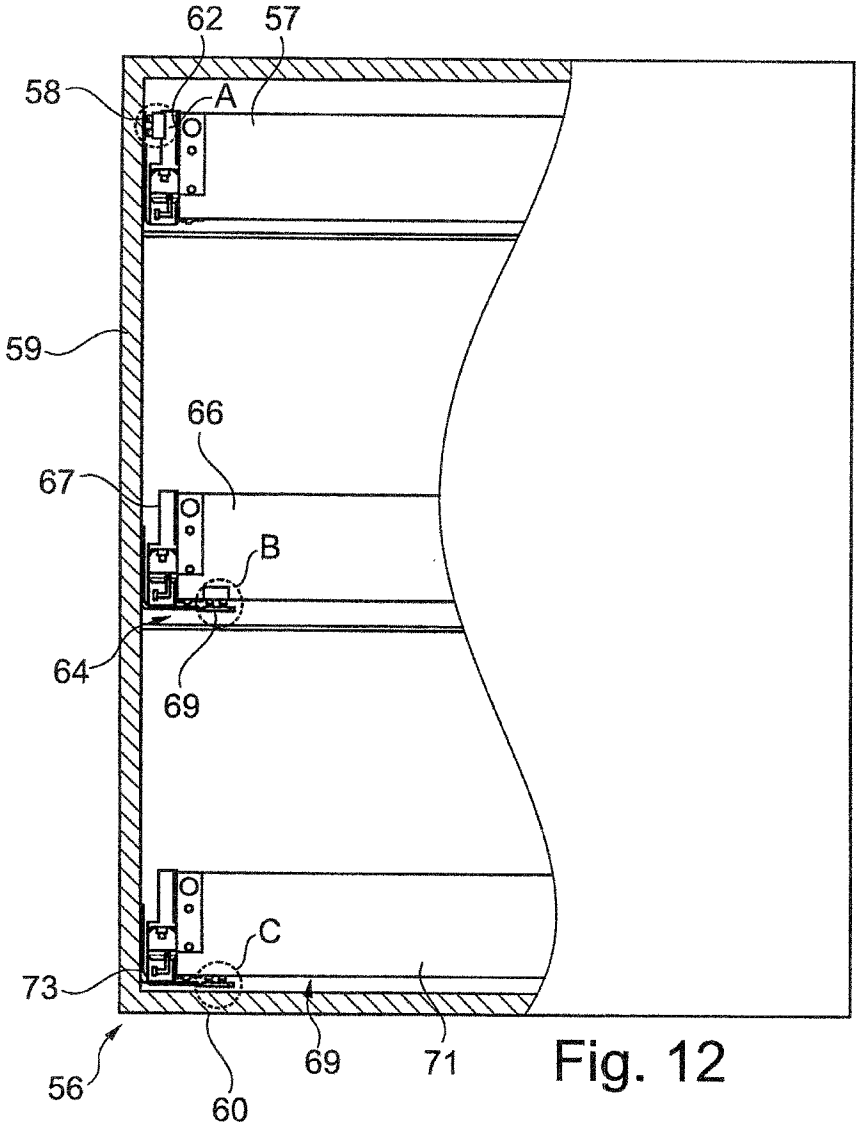
FIG. 12 shows a rear view of an item of furniture having movable furniture parts, a respective power supply unit being arranged on the movable furniture part, wherein the power supply units are designed differently.

Three different configurations of a power rail when mounted on an item of furniture 56 are shown in FIG. 12. In the first variant of a power rail according to FIG. 12, a power rail 58 is shown on the upper drawer 57 of the furniture 56, being fixed to a body side wall 59 of a body 60 of the furniture 56. An enlarged detail (detail A) from FIG. 12 is shown in FIG. 13. It is shown that, in this variant, the current collector 61 is arranged on the drawer side wall 62 of the drawer 57.

Figure 14:
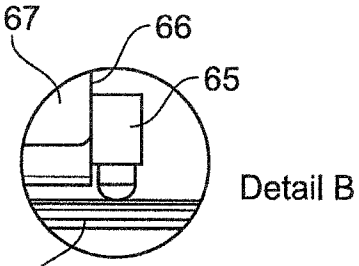

In the second variant according to FIG. 12, a power rail 63 is arranged on a pull-out guide 64. A current collector 65, which is illustrated enlarged in FIG. 14 (detail B), is preferably fixed to a rear side 66 of a drawer 67 in this variant.

Figure 15:
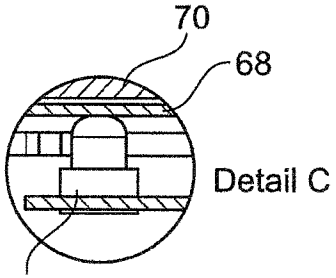

In the third variant according to FIG. 12, a power rail 68 is fixed to an underside 69 of a drawer bottom 70 of a drawer 71. In this variant, a current collector 72, which is displayed enlarged in FIG. 15 (detail C) is, for example, fixed underneath the drawer bottom 70 on a pull-out guide 73.

LIST OF DESIGNATIONS

1 Power rail
2 Contact element
3 Contact element
4 Base
5 Mounting element
6 Mounting element
7 Guide rail
8 Guide rail
9 Mounting member
10 Mounting member
11 Pull-out guide
12 Metal tab
13 Metal tab
14 Body rail
15 Central rail
16 Drawer rail
17 Attachment element
18 Power supply unit
19 Power rail
20 Current collector
21 Contact-making unit
22 Pull-out guide
23 Base
24 Rail
25 Contact element
26 Contact element
27 Current-collecting element
28 Current-collecting element
29 Housing
30 Attachment element
31 Fixing member
32 Cable
33 Current-collecting element
34 Mounting sleeve
35 Contact-making member
36 Connecting element
37 Stop element
38 Power rail
39 Screw
40 Fixing element
41 Power rail
42 Screw connection
43 Power supply unit
44 Rail
45 Pull-out guide
46 Transmitting element
47 Current receiving element
48 Housing
49 Attachment element
50 Mounting point
51 Furniture
52 Body
53 Drawer
54 Rear side
55 Rear wall
56 Furniture
57 Drawer
58 Power rail
59 Body side wall
60 Body
61 Current collector
62 Drawer side wall
63 Power rail
64 Pull-out guide
65 Current collector
66 Rear side
67 Drawer
68 Power rail
69 Underside
70 Drawer bottom
71 Drawer
72 Current collector
73 Pull-out guide

The invention claimed is:

1. A power rail for arrangement of a pull-out guide for a movable furniture part, wherein the pull-out guide has a body rail and a drawer rail that are supported such that they are movable relative to each other, the power rail comprising:

a power supply unit; and two electrically conductive contact elements, electrically insulated from each other, so that when a current collector of the power supply unit contacts one of the two contact elements, an electrically conductive connection is produced, wherein the power supply unit comprises a contact-making unit formed as strip, wherein the contact-making unit can be connected to an external power supply system by cables, wherein the contact-making unit has connecting elements to electrically conductively connect the cables to the contact element of the power rail, and wherein the contact-making unit can be fixed to the power rail by a fixing element in a clamping manner or by a screw connection, wherein, when arranged on a furniture, the contact-making unit applies an electrical voltage to the two contact elements of the power rail, wherein the power rail can be arranged on at least one of the body rail of the pull-out guide and on the drawer rail of the pull-out guide, and wherein the power rail, when arranged on the pull-out guide, extends along a length of the body rail of the pull-out guide and/or along a length of the drawer rail of the pull-out guide in a direction of movement of the pull-out guide.

2. The power rail as claimed in claim 1, wherein the power rail is detachably arranged on at least one of the body rail of the pull-out guide and the drawer rail of the pull-out guide.

3. The power rail as claimed in claim 1, wherein each contact element of the power rail is a wiping contact.

4. The power rail as claimed in claim 1, wherein the contact elements of the power rail, when arranged on the body rail and/or when arranged on the drawer rail, are spring-mounted.

5. The power rail as claimed in claim 1, wherein the contact elements are a current-conducting coating on the power rail.

6. The power rail as claimed in claim 1, wherein the power rail has a base on which the contact elements are present, wherein the power rail comprises a mounting element to arrange the power rail on at least one of the body rail of the pull-out guide and the drawer rail of the pull-out guide, and wherein the power rail is clamped to the mounting element.

7. The power rail as claimed in claim 1, wherein the power supply unit has a current collector that includes at least two current-collecting elements, wherein, when arranged on the furniture, a respective one of the current-collecting elements and a respective one of the two contact elements are in electrically conductive contact in one position, and wherein the current collector can be arranged on the power rail of the pull-out guide, on the body rail, on the drawer rail of the pull-out guide, on the movable furniture part and/or on a furniture body.

8. The power rail as claimed in claim 7, wherein the current collector of the power supply unit comprises a transmitting element that transmits energy without contacting a current receiving element.

9. The power rail as claimed in claim 7, wherein one of the current-collecting elements of the current collector of the power supply unit has a contact-making member to which a spring force is applied to make electrically conductive contact with the contact elements.

10. The power rail as claimed in claim 7, wherein the current collector of the power supply unit is detachably connected to the power rail.

11. The power rail of claim 10, wherein the current collector is detachably connected to a base of the power rail.

12. A pull-out guide comprising the power rail as claimed in claim 1.

13. An item of furniture having a pull-out guide as claimed in claim 12.

14. An item of furniture having a power rail as claimed in claim 1.

* * * * *